US007872408B2

(12) United States Patent
Liu et al.

(10) Patent No.: US 7,872,408 B2
(45) **Date of Patent: *Jan. 18, 2011**

(54) FIELD-EMISSION-BASED FLAT LIGHT SOURCE

(75) Inventors: Liang Liu, Beijing (CN); Jie Tang, Beijing (CN); Zhi Zheng, Beijing (CN); Li Qian, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 198 days.

This patent is subject to a terminal disclaimer.

(21) Appl. No.: 11/959,178

(22) Filed: Dec. 18, 2007

(65) Prior Publication Data

US 2008/0278060 A1 Nov. 13, 2008

(30) Foreign Application Priority Data

May 11, 2007 (CN) ..... 2007 1 0074431

(51) Int. Cl.
*H01J 1/62* (2006.01)

(52) U.S. Cl. ..... 313/495; 313/309; 313/311; 313/310; 313/496; 313/497

(58) Field of Classification Search ..... 313/309–311, 313/495–497
See application file for complete search history.

(56) References Cited

U.S. PATENT DOCUMENTS

| | | | | |
|---|---|---|---|---|
| 4,595,862 | A * | 6/1986 | Morimoto et al. | 315/169.4 |
| 2003/0015958 | A1 * | 1/2003 | Saito et al. | 313/495 |
| 2005/0212394 | A1 * | 9/2005 | Lin et al. | 313/309 |
| 2006/0022574 | A1 * | 2/2006 | Chen et al. | 313/495 |
| 2006/0126358 | A1 * | 6/2006 | Chen | 362/611 |
| 2006/0192476 | A1 | 8/2006 | Wei et al. | |
| 2006/0214556 | A1 * | 9/2006 | Ohwada et al. | 313/491 |
| 2006/0261726 | A1 * | 11/2006 | Choi et al. | 313/496 |
| 2007/0035941 | A1 * | 2/2007 | Lee et al. | 362/97 |
| 2007/0051965 | A1 | 3/2007 | Du et al. | |

FOREIGN PATENT DOCUMENTS

| | | | |
|---|---|---|---|
| CN | 1530320 | A | 9/2004 |
| CN | 1585067 | A | 2/2005 |
| CN | 1750227 | A | 3/2006 |

* cited by examiner

*Primary Examiner*—Bumsuk Won
(74) *Attorney, Agent, or Firm*—Jeffrey T. Knapp

(57) ABSTRACT

A field-emission-based flat light source includes the following: a light-permeable substrate; a plurality of line-shaped cathodes; an anode; a light-reflecting layer; and a fluorescent layer. The light-permeable substrate has a surface, and the line-shaped cathodes, with a plurality of carbon nanotubes formed and/or deposited thereon, are located on the surface of the light-permeable substrate. The anode faces the cathodes and is spaced from the cathodes to form a vacuum chamber. The light-reflecting layer is formed on the anode and faces the cathode. The fluorescent layer is formed on the light-reflecting layer.

8 Claims, 6 Drawing Sheets

FIELD-EMISSION-BASED FLAT LIGHT SOURCE

RELATED APPLICATIONS

This application is related to commonly-assigned application Ser. No. 11/959,132, entitled, "FIELD-EMISSION-BASED FLAT LIGHT SOURCE", filed on Dec. 18, 2007.

BACKGROUND

1. Field of the Invention

The present invention relates to a flat light source and, particularly, to a field-emission-based flat light source.

2. Discussion of Related Art

Flat light sources are widely used in many fields, especially in display technology. Many light receiving display devices, such as liquid crystal displays (LCDs), need a flat light source to provide a uniform incidence light. Generally, a flat light source used in LCD converts a linear light source to a flat, area light source through an optical means. However, the conventional flat light source typically inefficiently utilizes light energy.

To improve the efficiency of the light energy utilization, a conventional field-emission-based flat light source is provided. The field-emission-based flat light source includes a cathode electrode, a transparent anode electrode spaced from the cathode electrode, and a fluorescent layer formed on the anode electrode. When a predetermined voltage is applied between the anode electrode and the cathode electrode, electrons are able to emit from the cathode electrode and move to the anode electrode. When the emitted electrons collide against the fluorescent layer, a visible light is produced and transmitted through the transparent anode electrode and to the outside as a flat, area light source.

However, in the conventional field-emission-based flat light source, light emits from the anode electrode directly. The potential non-uniformity of the thickness of the fluorescent layer and/or of the electron emission from the cathode may induce a non-uniformity of light emission of the fluorescent layer. Therefore, the uniformity of luminance of the conventional field-emission-based flat light source is decreased.

What is needed is to provide a field-emission-based flat light source, in which the above problems are eliminated or at least alleviated.

SUMMARY OF THE INVENTION

A field-emission-based flat light source includes the following: a light-permeable substrate, a plurality of line-shaped cathodes, an anode, a light-reflecting layer, and a fluorescent layer. The light-permeable substrate has a surface, and the line-shaped cathodes, with a plurality of carbon nanotubes formed and/or deposited thereon, are located on the surface of the light-permeable substrate. The anode faces the cathodes and is spaced from the cathodes to form a vacuum chamber. The light-reflecting layer is formed on the anode and faces the cathode. The fluorescent layer is formed on the light-reflecting layer.

Other advantages and novel features of the present invention of the field-emission-based flat light source will become more apparent from the following detailed description of embodiments when taken in conjunction with the accompanying drawings.

BRIEF DESCRIPTION OF THE DRAWINGS

Many aspects of the present invention of the field-emission-based flat light source can be better understood with reference to the following drawings. The components in the drawings are not necessarily to scale, the emphasis instead being placed upon clearly illustrating the principles of the present field-emission-based flat light source.

Figure 1:
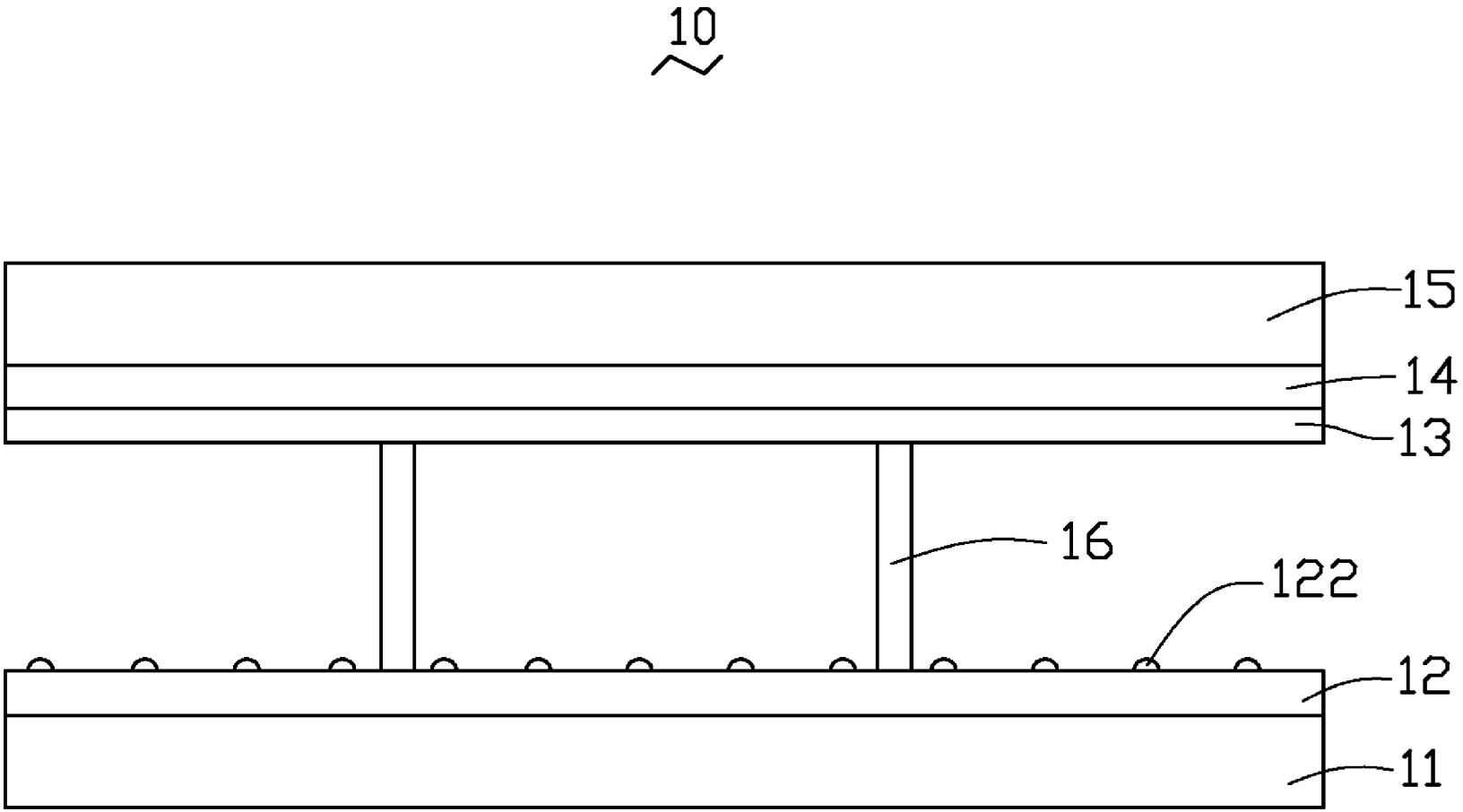
FIG. 1 is a cross-section view of a field-emission-based flat light source, in accordance with a first embodiment.

Corresponding reference characters indicate corresponding parts throughout the several views. The exemplifications set out herein illustrate at least one embodiment of the present field-emission-based flat light source, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present field-emission-based flat light source.

Figure 2:
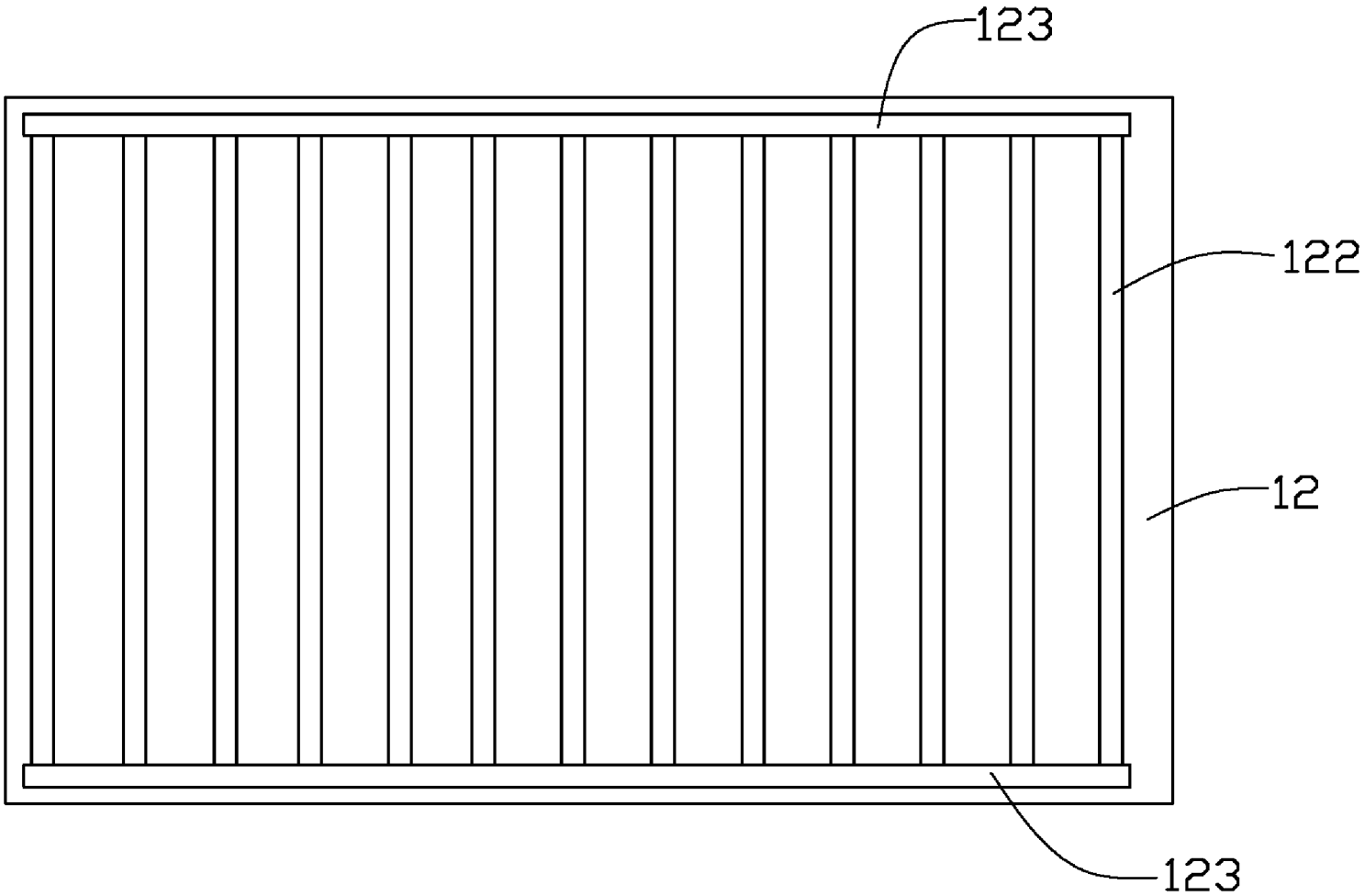
FIG. 2 is a schematic top view of the cathode of the field-emission-based flat light source, in accordance with the first embodiment.

Referring to FIG. 1 and FIG. 2, the field-emission-based flat light source 10 in the first embodiment includes a light-permeable substrate 11, a plurality of line-shaped cathodes 12, a fluorescent layer 13, a light-reflecting layer 14, an anode 15, and a plurality of spacers 16. The light-permeable substrate 11 has a surface, and the line-shaped cathodes 12, with a plurality of carbon nanotubes formed and/or deposited thereon, are located on the surface of the light-permeable substrate 11. The anode 15 faces the cathodes 12 and is spaced from the cathodes 12 to form a vacuum chamber. The light-reflecting layer 14 is formed on the anode 15 and faces the cathode 12. The fluorescent layer 13 is formed on the light-reflecting layer 14.

The spacers 16 are advantageously made of an insulative material, such as a glass or ceramic material, to provide a high strength and to avoid shorting between the cathode and the anode. The anode 15 can, usefully, be made of a conductive material, such as a metal, or of an insulative material with a conductive layer formed thereon. The conductive layer can, beneficially, be made of gold, silver, copper, aluminum, or nickel. The light-reflecting layer 14 can, advantageously, include a light-reflecting sheet or a light-reflecting film coated on the surface of the anode 15. Because of the high reflectivity of silver and/or aluminum, the conductive layer can be used as the light-reflecting layer 14 when the conductive layer is formed of silver and/or aluminum material.

The light-permeable substrate 11 can be made of a transparent material such as a transparent glass panel. The cathode 12 on the light-permeable substrate 11 may includes a plurality of metal wires 122 and a bus electrode 123. The electrical conductive metal wires 122 distributed uniformly on the light-permeable substrate 11 and the diameter is in the approximate range from 10 microns to 1 millimeter. Quite suitably, the material of metal wires 122 can, beneficially, be selected from nickel (Ni), tungsten (W), molybdenum (Mo), titanium (Ti), zirconium (Zr), or other metal and alloy commonly used in electro-vacuum devices. The bus electrode 123 can, advantageously, be made of the same metal, as the metal wires 122 or other metal have better conductivity than the material of the metal wires 122. Carbon nanotubes (CNTs) are disposed on the metal wires 122.

Quite suitably, the bus electrode 123 equally distributes current from electrical power source to each metal wire 122. It is to be understood that the bus electrode 123 is optional. In another embodiment, the metal wire can be contacted to the electrical power source directly, without the bus electrode 123.

In the first embodiment, the metal wires 122 are parallel to each other. As the amount of the metal wires 122 on the light-permeable substrate 11 increases, the electron emission will increase but the light output through the light-permeable substrate 11 will decrease. Thus, the distribution density of the metal wires 122 on the light-permeable substrate 11 is not specifically confined and only needed to provide a maximum light output. In one useful embodiment, the distance between two metal wires 122 is at least about 10 microns to about 10 millimeters.

In the flat light source 10 of the first embodiment, electrons emit from cathode 12 and collide with the fluorescent layer 13 on the anode 15. Visible light produced by the collision of the electrons partially emits directly from the light-permeable substrate 11. The other part of the visible light reflected by the light-reflecting layer 14 and emits from the light-permeable substrate 11. Due to the transmission step in the distance between the light-permeable substrate 11 and the anode 15, the uniformity of the luminance is increased. Further, the cathode 12 may, advantageously, include a transparent conductive layer.

The cathode 12 can be made by the method includes the steps of: (a) providing a carbon nanotube paste; (b) coating the nanotube paste on the surface of the metal wire 122; and (c) fixing the metal wire 122 on the light-permeable substrate 11.

In step (a), the carbon nanotubes paste consists of about 5%~15% carbon nanotubes, about 10%~20% conductive metal grains, about 5% low-melting point glass, and about 60% to 80% organic carrier. The material of conductive metal grains can, beneficially, be selected from a group consisting of indium tin oxide (ITO) and silver. The organic carrier is a mixture of terpineol as a solvent, a small amount/percentage of dibutyl phthalate as a plasticizer, and a small amount/percentage of ethyl cellulose as a stabilizer. In the present embodiment, the amount of terpineol, dibutyl phthalate and ethyl cellulose is in the ratio of about 90:5:5. The mixture can be sonicated (i.e., ultrasonically vibrated and mixed) to provide a paste with the above-mentioned paste components uniformly dispersed therein.

The conductive metal grains electrically connect the metal wires 122 with the transparent conductive layer, as well as the metal wires 122 with the carbon nanotubes formed thereon.

In step (b), the organic carrier is eliminated (e.g., via evaporation and/or burn-off) by drying the coating in an oven (e.g., at about 75° C.~120° C.) or in room temperature.

In step (c), the metal wires 122 can be fixed on the light-permeable substrate 11 through any of various means, including, for example: bonding the metal wires 122 with the light-permeable substrate 11 using a glue/adhesive or a binder; or sintering the metal wire 122 on the light-permeable substrate 11. The low-melting point glass can be melted through the sintering step. The melting glass bonds the carbon nanotubes on the metal wire 122 and fixes the metal wire 122 on the light-permeable substrate 11. In one useful embodiment, the step (c) further includes an abrasion step after drying and sintering of the metal wire 122, in order to enhance the field emission property. The carbon nanotubes extrude from the paste and have a preferred orientation after the abrasion step.

Figure 3:
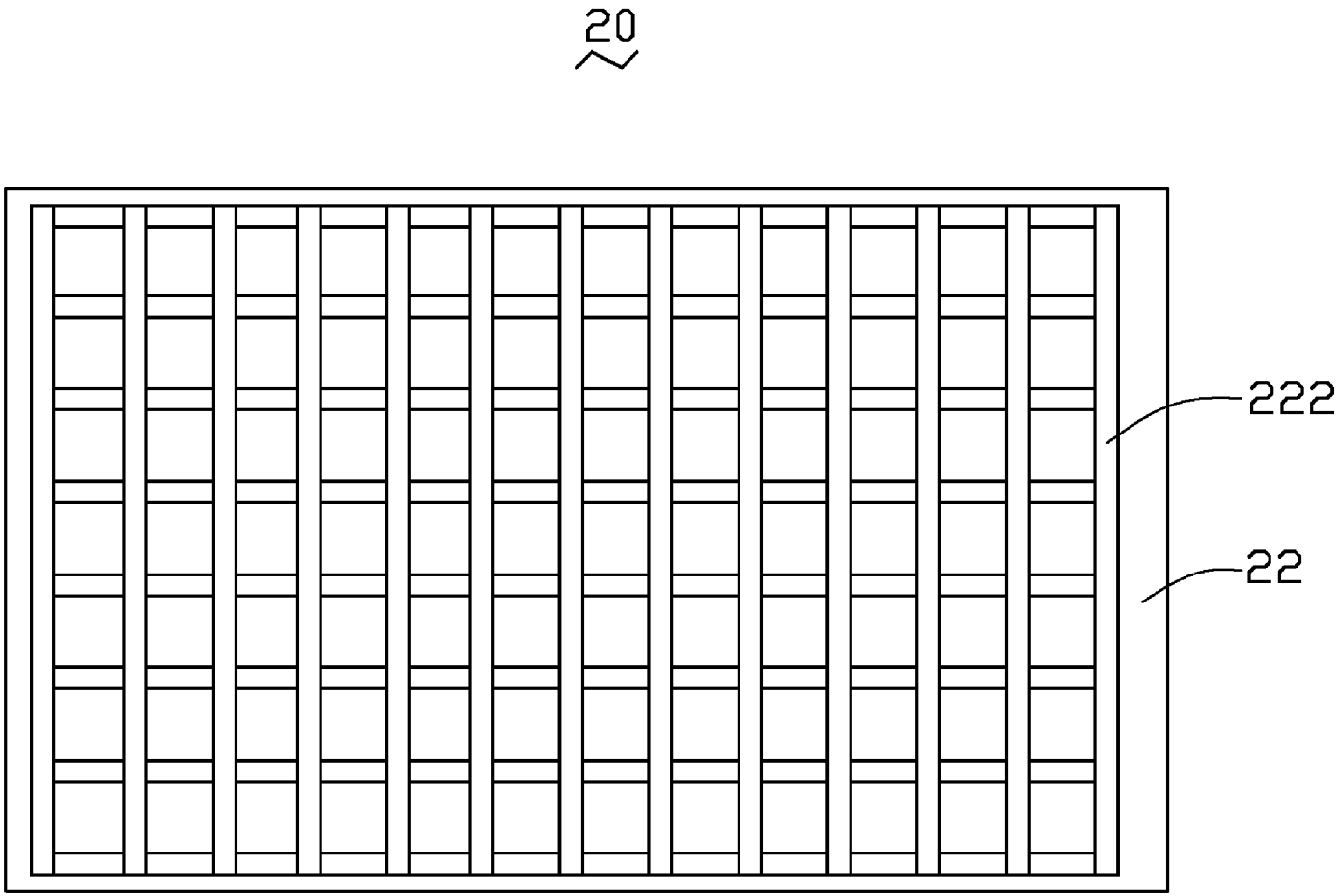
FIG. 3 is a schematic top view of the cathode of a field-emission-based flat light source, in accordance with a second embodiment.

Referring to FIG. 3, the field-emission-based flat light source 20 in the second embodiment is similar to the field-emission-based flat light source 10 in the first embodiment. A gird structure of the metal wires 222 is provided to improve the conductivity. Therefore, the bus electrode is unnecessary.

Figure 4:
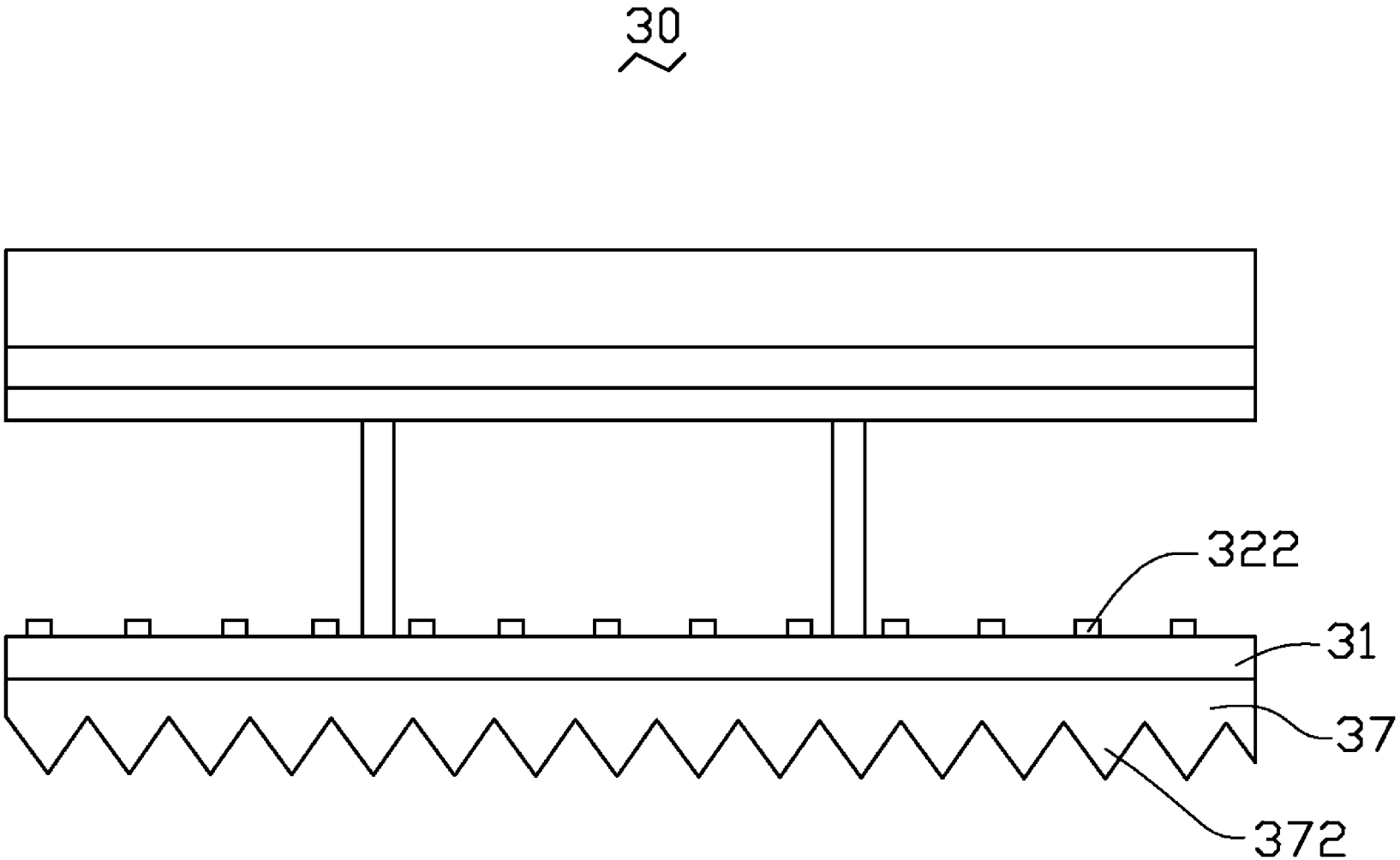
FIG. 4 is a cross-section view of a field-emission-based flat light source, in accordance with a third embodiment.

Referring to FIG. 4, the field-emission-based flat light source 30 in the third embodiment is similar to the field-emission-based flat light source 10 in the first embodiment. The cross-section of the metal wire 322 can be formed as a different shape. In one useful embodiment, the shape of the cross-section of the metal wire 322 is square. A diffuser plate 37 is disposed on the lower side of the light-permeable substrate 31 and includes a plurality of diffuser (i.e., light-diffusing) structures 372 formed directly thereon. The shape of the diffuser structures 372 of the diffuser plate 37 can, beneficially, be selected from a group consisting of convex or concave columns, semi-spheres, pyramids, pyramids without tips, and any combination thereof. In one useful embodiment, the diffuser structures 372 are pyramids formed by injection molding.

Figure 5:
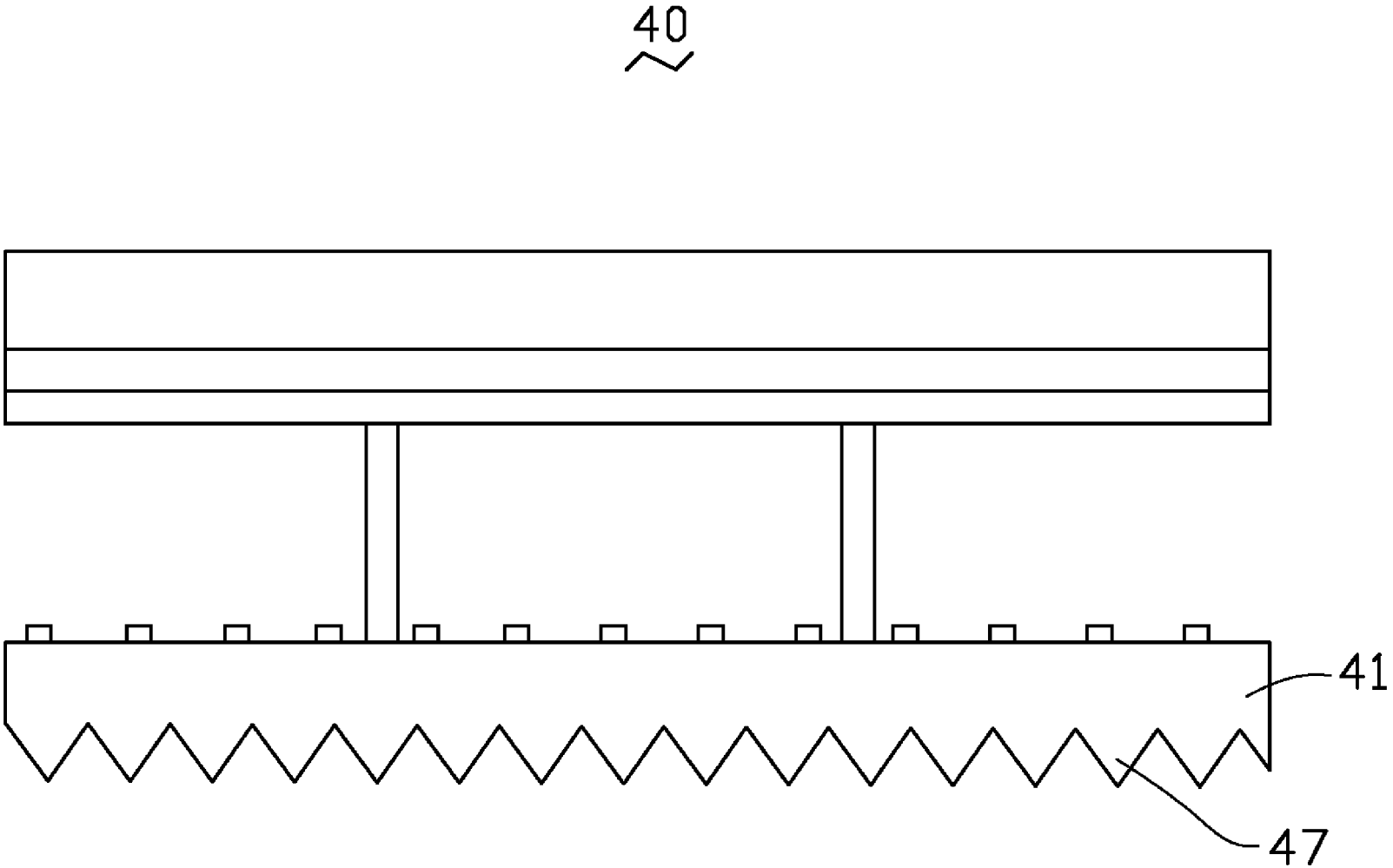
FIG. 5 is a cross-section view of a field-emission-based flat light source, in accordance with a fourth embodiment.

Referring to FIG. 5, the field-emission-based flat light source 40 in the fourth embodiment is similar to the field-emission-based flat light source 30 in the third embodiment. The light-permeable substrate 41 and the diffuser plate 47 are integrally formed (e.g., co-molded). Therefore, no interface between the light-permeable substrate 41 and the diffuser plate 47 exists. As such, the transmittance and luminescent efficiency of the flat light source 40 are elevated.

Figure 6:
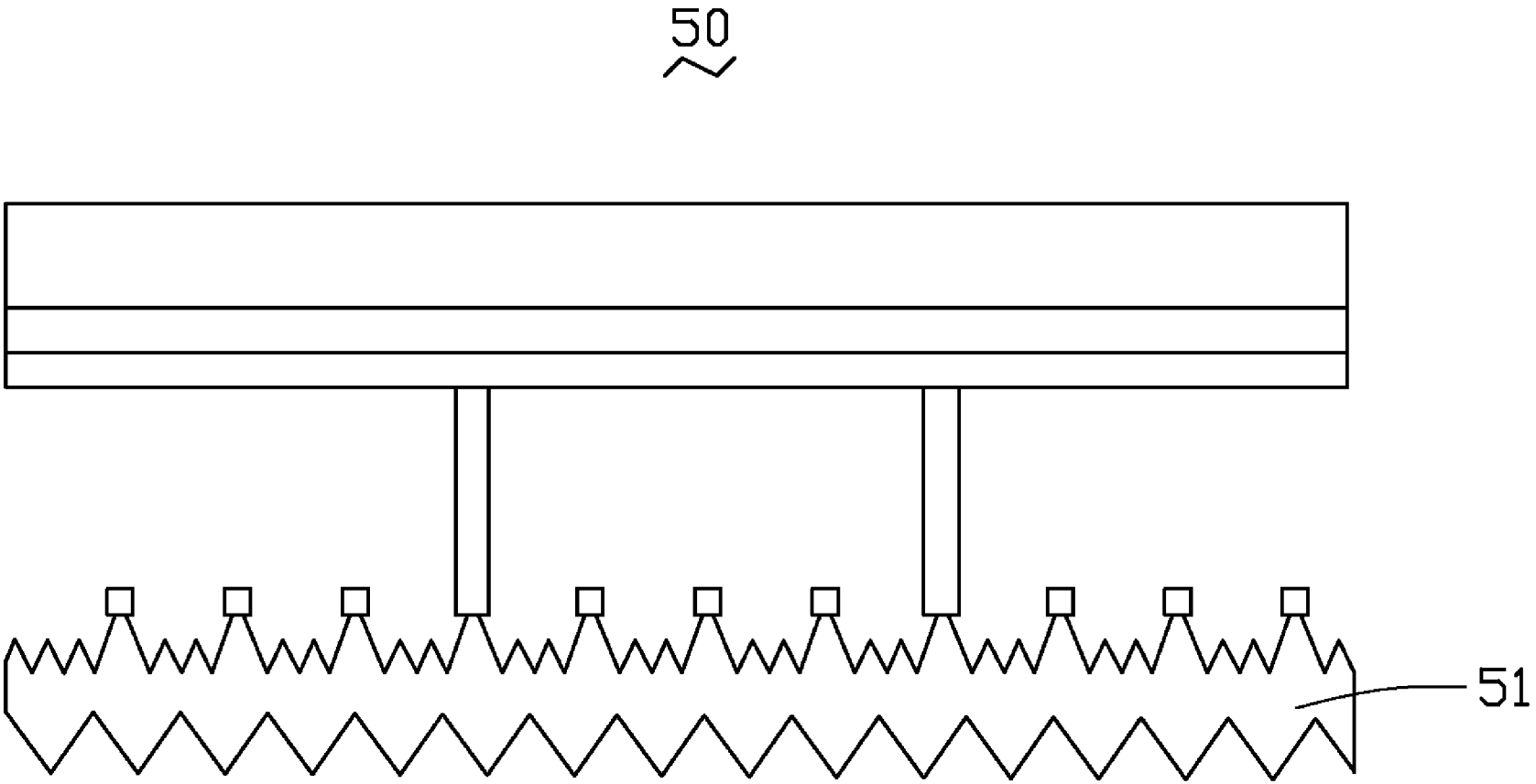
FIG. 6 is a cross-section view of a field-emission-based flat light source, in accordance with a fifth embodiment.

Referring to FIG. 6, the field-emission-based flat light source 50 in the fifth embodiment is similar to the field-emission-based flat light source 40 in the fourth embodiment. Two diffuser plates are formed on the two main opposite surfaces of the light-permeable substrate 51. The diffuser plates and the light-permeable substrate 51 are integrally formed (e.g., co-molded).

The two diffuser plates on the opposing sides of the light-permeable substrate 51 can be formed by, e.g., injection molding (i.e., inject the melted glass into a mold) or glass etching of the initial light-permeable substrate 51. The uniformity of the output light can be elevated through the light-permeable substrate 51, as there are no respective interfaces between it and the two diffuser plates associated therewith, and, of course, the two diffuser plates themselves promote uniform light output, via diffusion.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field-emission-based flat light source, comprising:

a light-permeable substrate having a first surface and a second surface opposite to the first surface;

a plurality of cathodes located on the first surface;

a plurality of first diffuser structures formed on the first surface between the cathodes;

an anode spaced from the cathodes to form a vacuum chamber;

a light-reflecting layer formed on the anode; and a fluorescent layer formed on the light-reflecting layer, the fluorescent layer faces the first surface.

2. The field-emission-based flat light source of claim 1, further comprising a plurality of second diffuser structures formed on the second surface.

3. The field-emission-based flat light source of claim 2, wherein the first diffuser structures and the second diffuser structures are selected from the group consisting of convex columns, concave columns, semi-spheres, pyramids, and pyramids without tips.

4. The field-emission-based flat light source of claim 1, wherein the cathodes are line-shaped.

5. The field-emission-based flat light source of claim 1, further comprising:

a transparent conductive layer formed on a periphery of each of the cathodes; and a carbon nanotube paste formed on the transparent conductive layer of each of the cathodes, the carbon nanotube paste comprising a plurality of carbon nanotubes, conductive metal grains and low-melting point glass.

6. A field-emission-based flat light source, comprising:

a light-permeable substrate having a first surface and a second surface opposite to the first surface;

a transparent conductive layer located on the first surface;

a plurality of line-shaped cathodes each comprising:

a wire located on the transparent conductive layer; and a carbon nanotube paste formed on the wire, the carbon nanotube paste comprising a plurality of carbon nanotubes, conductive metal grains, and low-melting point glass; the conductive metal grains electrically connecting the wire to the carbon nanotubes, and the conductive metal grains electrically connecting the wire to the transparent conductive layer, and the low-melting point glass securing the carbon nanotubes on the wire;

a plurality of diffuser structures formed on at least one of the first surface and the second surface of the light-permeable substrate;

an anode facing the plurality of line-shaped cathodes, and spaced from the plurality of line-shaped cathodes to form a vacuum chamber;

a light-reflecting layer formed on the anode, the light-reflecting layer facing the plurality of line-shaped cathodes; and a fluorescent layer formed on the light-reflecting layer.

7. The field-emission-based flat light source of claim 6, wherein wires of the plurality of line-shaped cathodes are spaced and parallel to each other.

8. The field-emission-based flat light source of claim 6, wherein wires of the plurality of line-shaped cathodes cross each other and form a grid structure on the surface of the light-permeable substrate.

* * * * *